US005321887A

United States Patent [19]

Boula

[11] Patent Number: 5,321,887

[45] Date of Patent: Jun. 21, 1994

[54] PROCESS FOR INDIVIDUAL IDENTIFICATION OF THE TUBES OF A HEAT EXCHANGER

[75] Inventor: Gérard Boula, Corpeau, France

[73] Assignee: Framatome, Paris, France

[21] Appl. No.: 956,284

[22] Filed: Oct. 5, 1992

[30] Foreign Application Priority Data

Oct. 2, 1991 [FR] France ..... 91 12129

[51] Int. Cl.[5] ..... B23P 15/26

[52] U.S. Cl. ..... 29/890.043; 29/407; 29/890.053; 72/367

[58] Field of Search ..... 29/890.053, 407, 890.043; 72/367; 138/104

[56] References Cited

U.S. PATENT DOCUMENTS

| | | | |
|---|---|---|---|
| 2,600,254 | 6/1952 | Lysobey | 101/35 |
| 3,440,705 | 4/1969 | Johnson | 101/36 |
| 3,815,493 | 6/1974 | Broderick | 72/461 |
| 4,779,437 | 10/1988 | Kubiak | 72/478 |
| 4,848,120 | 7/1989 | Schwarze | 72/34 |
| 5,009,093 | 4/1991 | Quinn, Jr. et al. | 72/177 |

FOREIGN PATENT DOCUMENTS

| | | | |
|---|---|---|---|
| 201641 | 3/1970 | France | 72/197 |
| 0002257 | 1/1979 | Japan | 72/368 |

*Primary Examiner*—Irene Cuda

*Attorney, Agent, or Firm*—Pollock, Vande Sande & Priddy

[57] ABSTRACT

To permit individual identification of each of the tubes (10) of a steam generator, the tubes are marked with the aid of a binary bar code (12*a*) formed from circular impressions (24) and the absence of impressions. The impressions, formed without material removal, make it possible to read the bar code with the aid of an eddy current probe. The impressions (24) can be made on the exterior of the tubes (10) during their manufacture, or on the interior of the tubes after they have been fixed to the tube plate (16).

10 Claims, 3 Drawing Sheets

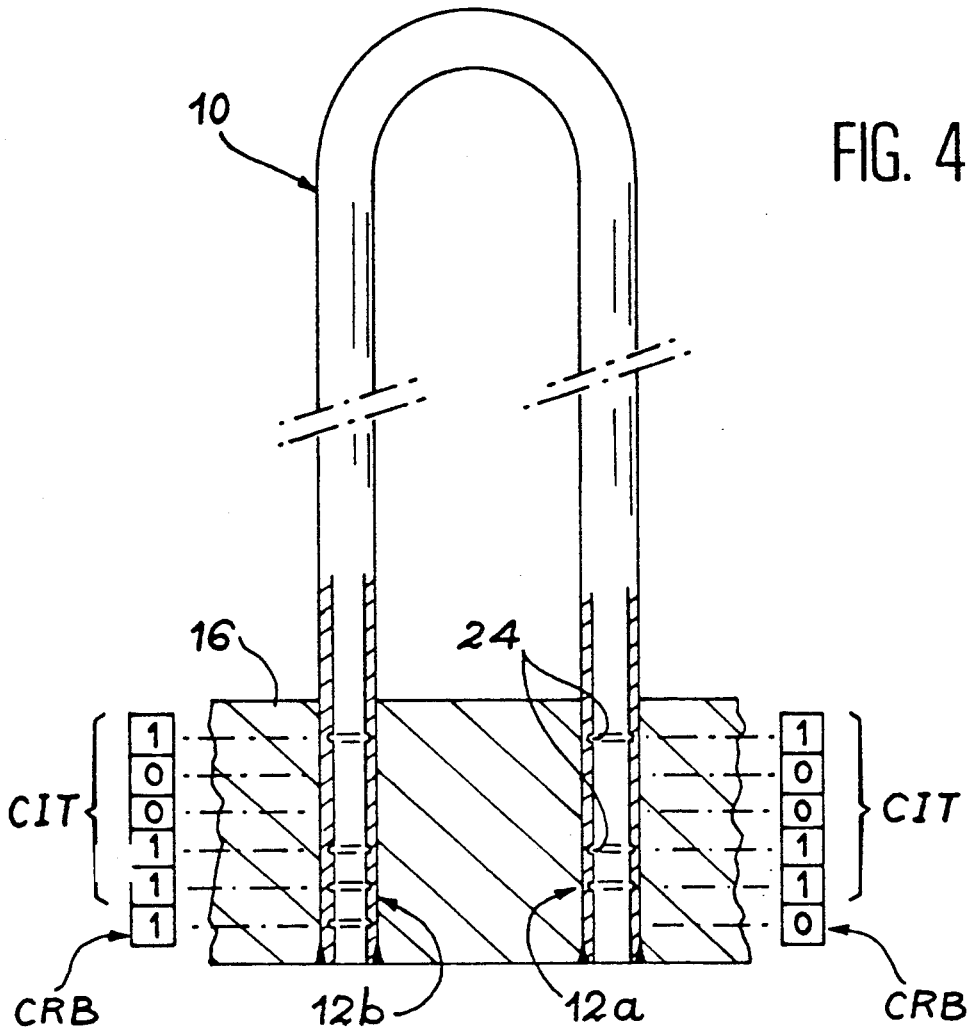
FIG. 4
FIG. 5
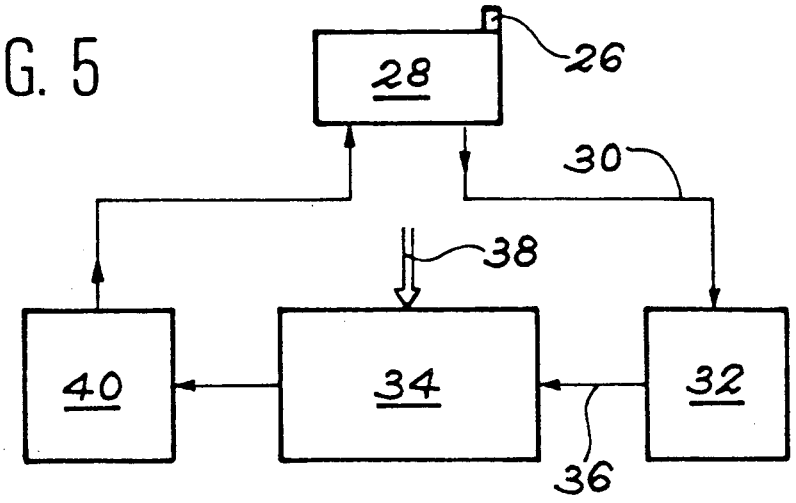

PROCESS FOR INDIVIDUAL IDENTIFICATION OF THE TUBES OF A HEAT EXCHANGER

FIELD OF THE INVENTION

The invention relates to a process making it possible to individually identify the tubes of a heat exchanger, such as a steam generator, used in a nuclear power station, in order to ensure immediate identification of a random tube throughout the life of the apparatus.

BACKGROUND OF THE INVENTION

The steam generators equipping nuclear power stations have several thousand inverted U-tubes arranged in the form of groups or bundles and whose two ends traverse a thick plate, called a tube plate, in which each of the tubes is welded and then expanded. This tube plate ensures the heat exchange between the water, known as the primary water, flowing in the primary circuit of the reactor and water flowing in the secondary circuit, known as the secondary water. The temperature of the primary water within each of the tubes consequently decreases significantly between their intake end and their outlet end. For this reason, the term "hot branch" and "cold branch" is commonly used for the upward and downward branches of the tubes, respectively extending the intake and outlet ends for the primary water.

The inverted U-shaped tubes of the tube bundle of a steam generator are housed within a vertically axial, cylindrical envelope, in which the tube plate is fixed. As a result most of the tubes have geometrical characteristics which differ from one another. In view of the fact that the location of manufacture of the tubes is generally different from that of the steam generator assembly, the individual identification of the tubes must take place before they are moved to the assembly point. At present, this identification takes place by placing on each of the tubes an adhesive label, on which is written a code guaranteeing its installation at the appropriate location on the steam generator tube plate. As soon as this location has been identified, the label is removed and the tube is put into place in the steam generator and welded to the tube plate.

This procedure for the identification of the tubes is only partly satisfactory. Thus, the adhesive labels can be lost during tube handling operations and they require a not insignificant, subsequent control time, with all the associated error risks. Moreover, the present individual tube identification procedure in no case makes it possible to identify the tubes in cartesian coordinates on the tube plate, in order to carry out on the tubes machining, checking or maintenance operations, after they have been fixed to the tube plate.

In particular, it is not at present possible to individually identify the tubes of a generator in cartesian coordinates, in order to carry out automatically machining in the factory or sealing on site of certain of these tubes, following an inspection carried out using an eddy current probe. There is consequently an appreciable time loss, and on the actual site the inspection personnel is exposed to the highly irradiating medium of the primary circuit for a much longer time than is strictly necessary for sealing certain of the tubes.

Moreover, the individual identification of the tubes from the start of their manufacture would make it possible to control the latter under particularly advantageous conditions, which is not possible when the tubes are identified with the aid of labels which can only be placed on the tubes when their manufacture is completed.

SUMMARY OF THE INVENTION

The main object of the invention is a process for the individual identification of the tubes of a heat exchanger, such as a steam generator, making it possible to individually identify each of the tubes throughout the life of the apparatus and, if appropriate, during the manufacture of the tubes.

According to the invention, this object is achieved by means of an individual identification process for the tubes of a heat exchanger having a bundle of tubes whose end portions are fixed in at least one tube plate. The process consists of marking each of the tubes with an individual code, which can be read by reading means at least during the operation of the exchanger.

The individual marking of each of the tubes, which can take place either at the time of the assembly of the steam generator or during the individual manufacture of the tubes, in all cases allows the identification of each of the tubes of an exchanger throughout its life. This results in an appreciable time gain and a significantly reduced exposure of the personnel to radiation after a prior learning operation has taken place, immediately following the manufacture of the steam generator, so as to associate with each of the tube identification codes position coordinates of the ends of the tubes on the tube plate.

According to a preferred embodiment of the invention, the tubes are marked by making impressions modifying their thickness, which makes it possible to ensure the reading of the individual code allocated to each of the tubes with the aid of an eddy current probe, which also inspects the tubes, No supplementary operation is necessary, Advantageously, in order not to weaken the tubes at the marking point, the impressions take place by embossing and without material removal.

Preferably, the individual identification code of each of the tubes is a bar code, which consists of a predetermined number of signs regularly spaced along the tube axis, each sign being chosen from among two signs, whereof one is a circular impression and the other an absence of an impression.

In the particular case of a steam generator incorporating inverted U-tubes, each including a cold branch and a hot branch and whose ends are fixed in the same tube plate, the process according to the invention consists of marking the end portions of each of the tubes with an individual code incorporating the same tube identification code and a branch identification code. In this case, the sign closest to the tube end can constitute the branch identification code.

In order that the identification of the tubes takes place as from the entrance of the eddy current inspection probe and also so as not to weaken the working parts of the tubes, the individual identification code is advantageously marked on the end portion of each of the tubes fixed in the tube plate.

In a first embodiment of the invention, the individual code is marked on an outer surface of each of the tubes during their manufacture. Moreover, as a result of the fact that it allows an individual identification of the tubes prior to the manufacture of the steam generator, this solution makes it possible to ensure the expansion of the tubes by heat treatment during their manufacture, so as to eliminate the residual stresses possibly created in the marking zones.

In another embodiment of the invention, the individual code is marked on an internal surface of each of the tubes after fixing the latter in the tube plate. It is obvious that this solution does not obviate the need for using adhesive labels or the advantages resulting therefrom. However, it does allow individual control of a steam generator tube, which was not possible up to now.

BRIEF DESCRIPTION OF THE DRAWINGS

The invention is described in greater detail hereinafter relative to several embodiments thereof and with reference to the attached drawings.

FIG. 4 shows schematically an inverted U-tube of a steam generator, whose two ends have been identified with the aid of a bar code according to the invention.

FIG. 5 is a flow diagram showing how the marking process according to the invention can make it possible to move without time loss an inspection probe or a random tool up to a given tube in the bundle.

DESCRIPTION OF PREFERRED EMBODIMENT

Each of the tubes of a steam generator is shaped in the form of a U-tube, the U being inverted when the steam generator is operating. As has been stated, the tubes all have different dimensional characteristics, as a function of their location within the steam generator. In particular, the radius of curvature of the central part of the tube and the length of the hot and cold branches of each tube varies between the individual tubes. One of the tubes, designated 10 in FIG. 1, has been shown towards the end of its manufacture, i.e., when it already has its definitive shape.

According to a first embodiment of the invention, it is at this stage or even prior to the curvature of the tube 10 that the tube is marked on its end portions using an individual bar code 12*a*,12*b*, which will be shown hereinafter as having for a given tube 10 the same identification code, as well as a code identifying the particular branch.

The principle used for the bar code will be explained in detail hereinafter. The marking of the bar code is obtained by making impressions by embossing and without material removal, so that the tube thickness is slightly decreased at the locations where the impressions are made. Each of the impressions used for making the bar codes 12*a*,12*b* is a circular impression 12, made over a partial or complete tube circumference and whose depth can be a few hundredths of a millimeter, while having the minimum operational mechanical strength thickness for the tube.

Figure 1:
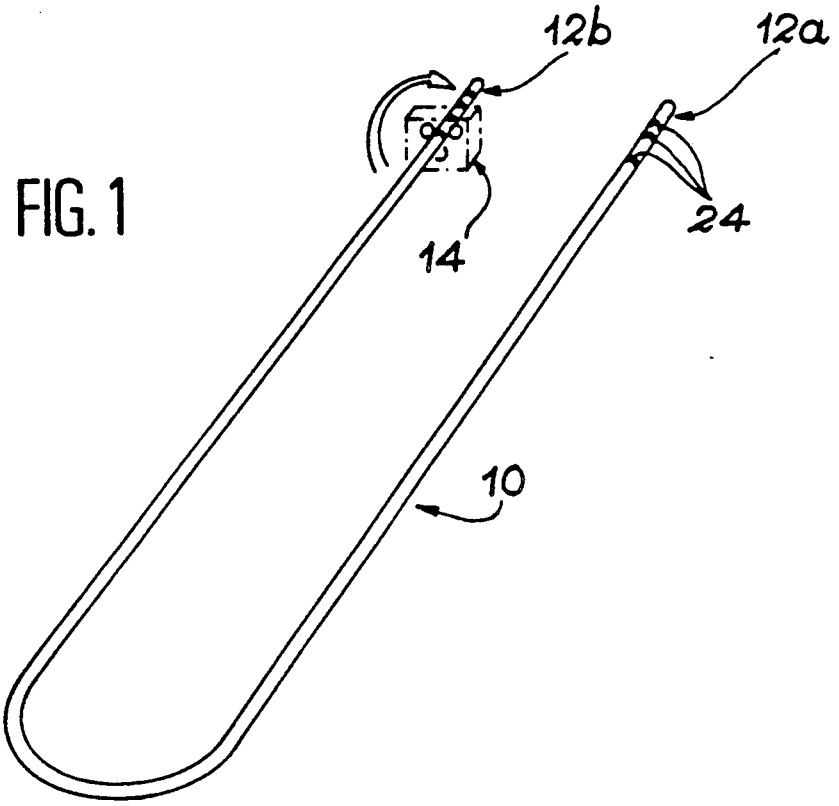
FIG. 1 is a schematic perspective view of a first embodiment of the invention, according to which the tubes are individually marked on their outer surface during manufacture.

In the first embodiment of the invention illustrated in FIG. 1, the marking of the end portions of each of the tubes 10 can be carried out on their outer surface, because they have not yet been fitted in a steam generator tube plate. As is schematically shown, the marking tool 14 is then a rotary tool, which can be fitted to the tube 10 and provided with marking rollers able to make the desired impressions. This marking tool 14 is advantageously installed on a carrier with coordinate control (not shown), which makes it possible to place the impressions of the bar codes 12*a*,12*b* at very precise locations with respect to the ends of the tube 10. Thus, the location of each of the impressions 24 is determinative for the reading of the bar codes.

Figure 3:
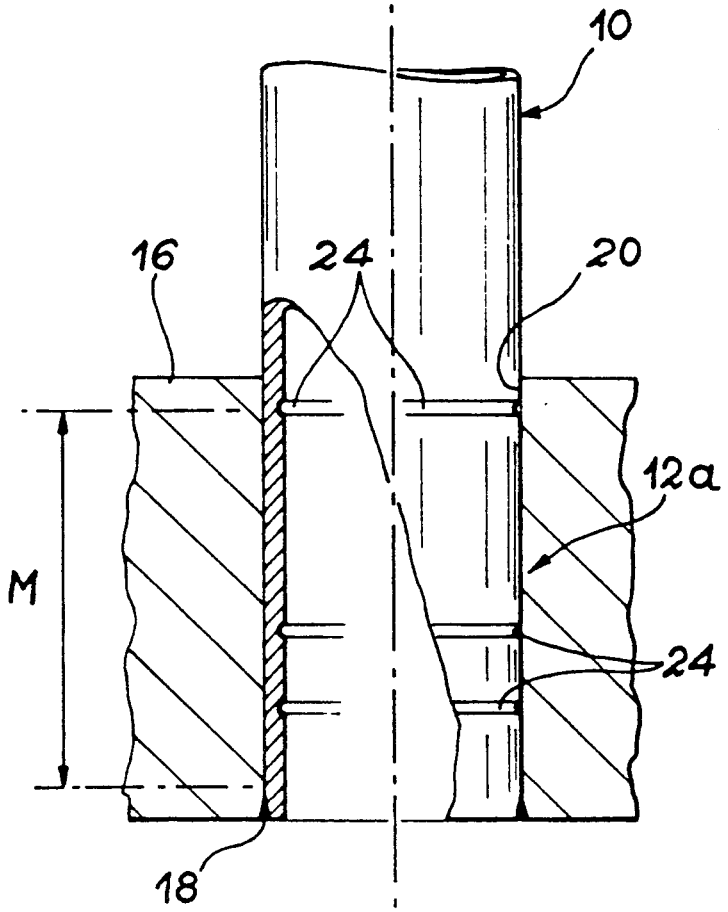
FIG. 3 is a partly sectional view illustrating on a larger scale one of the ends of a tube on which has been marked an individual identification code, the left and right-hand halves of the figure respectively illustrating the first and second embodiments of the invention.

As illustrated in greater detail bye. FIGS. 3 and 4, the end portions of the tubes 10, on which are marked the individual bar codes 12*a*,12*b*, correspond to the portions of the tubes 10 to be fixed in the tube plate 16 of the steam generator.

More specifically, the marking zone designated M in FIG. 3 is located within the bore 20 of the tube plate 16, in which is received the end portion of the tube 10. This marking zone M is defined between the region immediately adjacent to the weld 18, by which the end of the tube 10 is fixed on the lower face of the plate 16 on the primary water side, and the region adjacent to the upper face of the plate 16, corresponding to the expansion transition zone of the tube 10 within the bore 20 on the secondary water side. Thus, these two regions constitute the sensitive parts of the connection of the tube 10 to the plate 16, which must not be weakened by the marking of the tubes.

When each of the tubes 10 is marked by an individual bar code during its manufacture, as schematically illustrated in FIG. 1, all the characteristics associated with the tube, such as its metallurgical, quality and other characteristics, are then associated with the individual code carried by the tube. This solution makes it possible to avoid the identification of the tubes with the aid of adhesive labels, which is carried out at present prior to their despatch to the steam generator assembly location. The disadvantages associated with the use of these labels, such as the fact that they can become lost, the resulting error risks, the time necessary for their subsequent control, are eliminated.

Following its transport to the place of manufacture of the steam generators, each of the individually code-marked tubes is fixed to the tube plate 16 in the bores 20 for receiving it, by the formation of the weld 18 and then by expansion, according to standard procedures. Each of the tubes 10 and the two associated bores 20 thus create an inseparable assembly, individually identified by the code marked on the tube end. An informatic cartography is then produced in the factory, or after installing the steam generator in the nuclear power station, in order to associate with each individual bar code a position information, in cartesian coordinates, representing the position on the tube plate 16 of the end of the tube 10 carrying the particular code, and the bore 20 in which the end is received. A follow-up and control of each of the tubes throughout its life, from its manufacture to the shutdown of the steam generator, can thus be carried out.

The first embodiment of the invention, in which marking takes place on the outer skin of each of the tubes, also makes it possible to ensure good protection of the marking zone located, as illustrated in FIG. 3, in the tight part M. This embodiment also has the advantage of not modifying the steam generator manufacturing cycles and, if necessary, permits detensioning of the marking zones, by heat treatments or the like, during the manufacture of the tubes, if it is found that the marking creates residual stresses in the tubes.

Figure 2A:
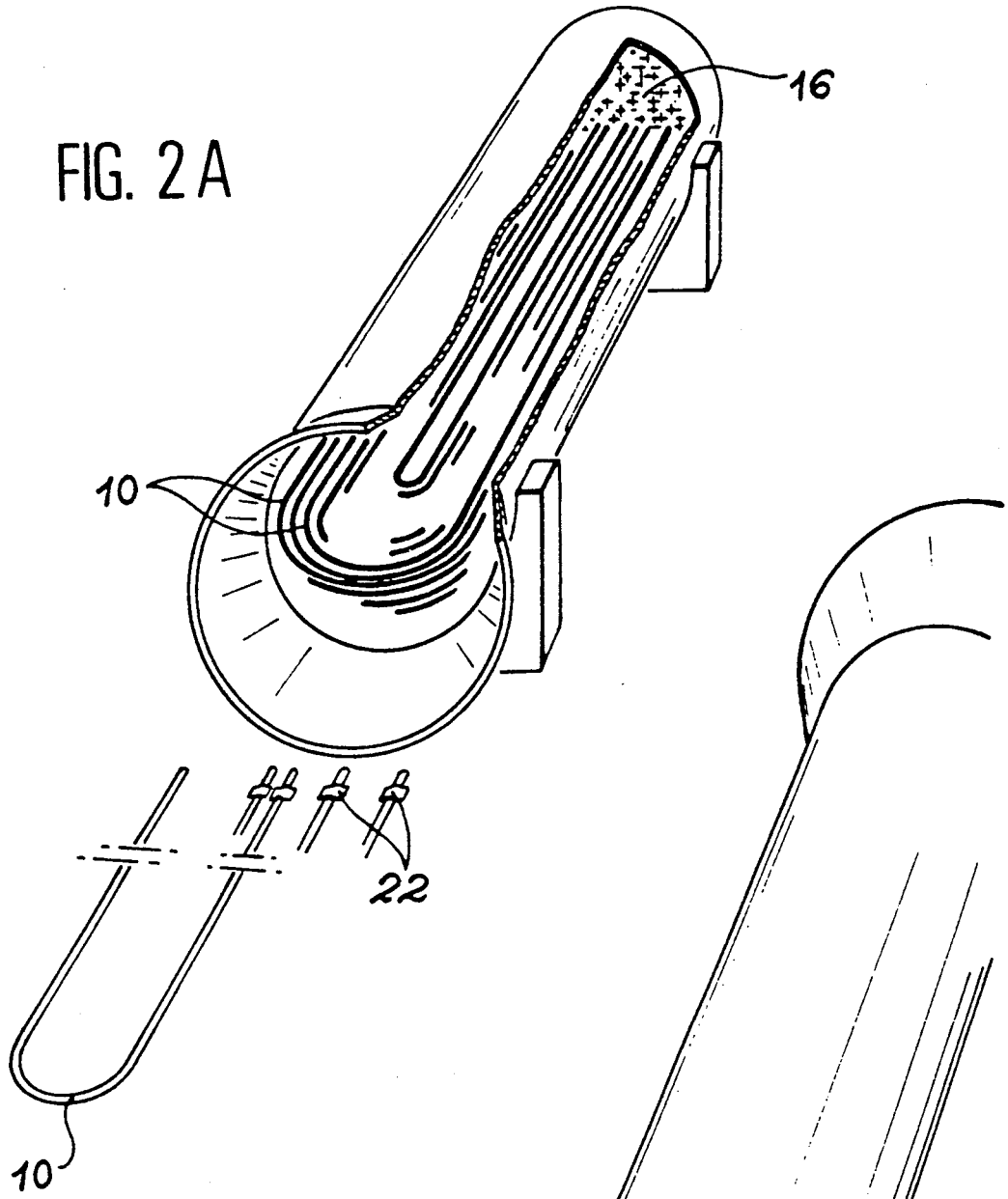
FIGS. 2A and 2B are perspective views illustrating two successive stages of the identification process according to second embodiment of the invention, according to which the tubes are marked internally during the assembly of the steam generator.
Figure 2B:
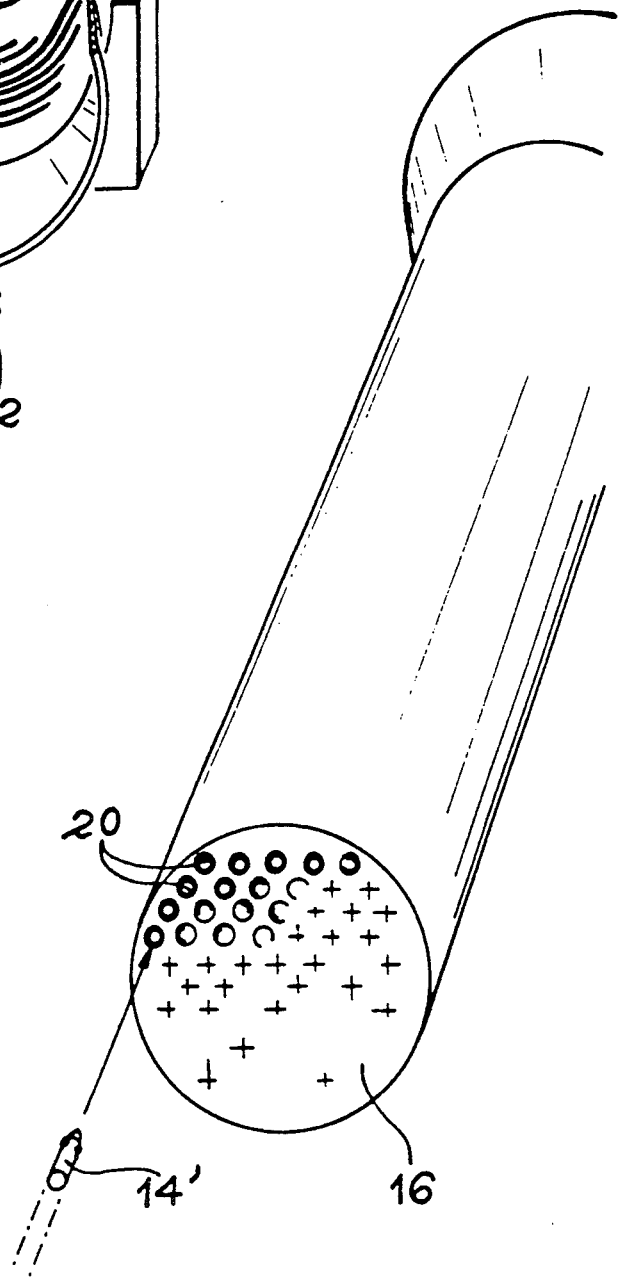

In a second embodiment of the invention, illustrated in FIGS. 2A and 2B, the marking of the tubes takes place only after they are fixed to the steam generator tube plate, either in the factory during the manufacture of the equipment, or directly in the nuclear power stations on already operating steam generators.

FIGS. 2A and 2B illustrate the case where the tube marking takes place immediately following their assembly on the tube plate 16. As illustrated in FIG. 2A, the tubes 10 then reach the steam generator assembly factory equipped in each case with their identification label 22 in accordance with the prior art. As soon as the tube 10 is put into place in the appropriate bores 20 of the tube plate 16, as illustrated in FIG. 2B, it is fixed in the latter by the conventional procedure, i.e., by welding and expansion. An individual bar code is then marked on the interior of the end portion of each of the tube branches located in zone M in FIG. 3 and in accordance with the identification codes initially carried on the labels 22.

In this embodiment, the marking tool 14' can be in the form of a special tube expander or an expansible ring provided with a bushing containing marking punch. In order to ensure a precise positioning of each of the impressions formed by the tool 14', the latter is installed on a carrier with coordinate control, such as a robot (not shown).

In the particular case where marking takes place directly on the nuclear power station site, the marking tool is installed on a carrier vehicle able to move beneath the tube plate and in accordance with a procedure comparable to that of vehicles supporting the eddy current inspection probes and equivalent systems, during inspection operations taking place On the power station site.

The characteristics relative to the impressions 24, both as regards their position and the way in which they are produced without material removal, are identical to those described hereinbefore relative to the first embodiment of the invention and with reference to FIG. 3.

The principle used for the individual encoding of each of the tubes will now be described relative to FIG. 4 and is the same in both the embodiments.

As has been stated, encodings using the bar code principle is based on the formation of circular impressions 24 and having in section a completely reproducible geometry, which is determined by the type of tool used for making the marking. The encoding proposed here is based on the use of a single type of impression 24, which can be decoded on an all-or-nothing basis during the passage of an eddy current probe, which is also used for inspecting the corresponding tube.

More specifically, the bar code is carried on each of the end portions M (FIG. 3) of each of the tubes 10 and has a predetermined number of signs regularly spaced by a known distance and, as a function of the particular case, these signs can either be a circular impression 24, or the absence of an impression. The position of each of the signs with respect to the tube end is also known.

The number of signs on the end portion of each of the tubes is chosen, as a function of the total number of tubes contained in a steam generator, so that each of the tubes carries an individual code permitting its identification. Bearing in mind the binary nature of the code used (impression:1; absence of impression:0), each of the tubes of a steam generator having approximately 5600 tubes could thus be identified with the aid of a code constituted by thirteen regularly spaced, consecutive signs, each formed either by an impression 24, or by an absence of impression. To facilitate reading, only six signs appear in FIG. 4.

Advantageously, one of the signs, e.g., that closest to the end of the tube 10 and designated by the letters CRB in FIG. 4, corresponds to a code for identifying the particular branch of the tube 10, an absence of impression, e.g., corresponding to the cold branch, whereas an impression 24 corresponds to the hot branch. The remainder of the signs contained in each of the individual codes **12*a*,12*b*** is also identical and corresponds to the tube identification code, designated by the letters CIT in FIG. 4.

Obviously, this solution is only given by way of example, any comparable encoding permitting both the identification of the particular branch of the tube and the identification of the tube with respect to all the tubes falling within the scope of the invention.

No matter which embodiment is used, as soon as the individual marking of the tubes is finished, or at the end of steam generator manufacture when the marking of the tubes takes place prior to that manufacture, there is a learning or acquisition of all the signals corresponding to the said codes with the aid of an eddy current probe 26 installed on a mobile carrier vehicle 28, by associating therewith the positions of the corresponding ends of the tubes 10 on the tube plate 16. Thus, an informatic cartography is established of the position of these signals on the tube plate 16. This acquisition operation is schematically illustrated in FIG. 5 by the arrow 30, which connects the eddy current probe 26 to an acquisition circuit 32 for the signals supplied by the probe 26. The acquisition circuit 32 supplies a computer 34 with encoding signals 36, to which the computer 34 allocates a position in cartesian coordinates on the basis of a coordinate table. The desired cartography is thus stored.

When it is subsequently desired to carry out a random operation, e.g., machining or sealing on a given tube 10, a position message 38 corresponding to the sought tube is fed into the computer 34, as indicated by the arrow 36 in FIG. 5. On the basis of this message, the computer consults the previously acquired cartography in order to control an automatic displacement of the carrier vehicle 30 towards the sought position, by acting on the vehicle control members 40. The invention applies to the individual identification of the tubes of a heat exchanger having a bundle of straight tubes, whose ends are fixed on two facing tube plates.

I claim:

1. Process for individual identification of tubes of a heater exchanger comprising a bundle of tubes having end portions fixed in at least one tube plate, said process comprising the steps of (a) marking each of said tubes with an individual code, at the latest when said tubes have been fixed in said tube plate, the individual codes remaining on said tubes throughout the life of said heat exchanger;

(b) after fixing said tubes to said tube plate, carrying out a learning operation during which each of said codes is associated with position coordinates of said tube end portions on said tube plate; and (c) reading said individual codes by reading means at any time that identification of said tubes is required.

2. Process according to claim 1 including marking the tubes by making impressions modifying their thickness.

3. Process according to claim 2, wherein the impressions are made by embossing and without material removal.

4. Process according to claim 1, wherein the individual code is a bar code.

5. Process according to claim 4, wherein the bar code comprises a predetermined number of signs regularly spaced along the tube axis, each sign being chosen from among two signs, one of which signs being a circular impression and the other of the signs being constituted by an absence of an impression.

6. Process according to claim 5, applied to the identification of U-tubes having a cold branch and a hot branch and whereof the end portions are fixed in the same tube plate, wherein said process consists of marking the end portions of each of the tubes with an individual code having a same tube identification code and a branch identification code.

7. Process according to claim 6, wherein a sign closest to the end of the tube constitutes the branch identification code.

8. Process according to claim 1, wherein the individual code is marked on the end portion of each of the tubes fixed in the tube plate.

9. Process according to claim 1, wherein the individual code is marked on an outer surface of each of the tubes during their manufacture.

10. Process according to claim 1, wherein the individual code is marked on an internal surface of each of the tubes after the fixing of the latter in the tube plate.

* * * * *